US007928043B2

(12) United States Patent
Mayhew et al.

(10) Patent No.: US 7,928,043 B2
(45) Date of Patent: Apr. 19, 2011

(54) LUBRICATING COMPOSITIONS

(75) Inventors: Alexandra Mayhew, Wirksworth (GB); Stephen J. Cook, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 333 days.

(21) Appl. No.: 12/089,579

(22) PCT Filed: Oct. 13, 2006

(86) PCT No.: PCT/US2006/040115

§ 371 (c)(1),
(2), (4) Date: Aug. 20, 2008

(87) PCT Pub. No.: WO2007/044909

PCT Pub. Date: Apr. 19, 2007

(65) Prior Publication Data

US 2008/0318818 A1 Dec. 25, 2008

Related U.S. Application Data

(60) Provisional application No. 60/727,107, filed on Oct. 14, 2005.

(51) Int. Cl.
*C10M 159/24* (2006.01)

(52) U.S. Cl. ..... 508/391; 508/392; 508/393

(58) Field of Classification Search ..... 508/391, 508/392, 393

See application file for complete search history.

(56) References Cited

U.S. PATENT DOCUMENTS

| | | | | |
|---|---|---|---|---|
| 7,316,992 | B2 | 1/2008 | Natoli et al. | 508/111 |
| 2003/0073590 | A1* | 4/2003 | Chambard et al. | 508/391 |
| 2003/0159672 | A1 | 8/2003 | Carey et al. | |
| 2003/0183188 | A1* | 10/2003 | Carey et al. | 123/195 |
| 2003/0196632 | A1* | 10/2003 | Reischman et al. | 123/196 R |
| 2004/0144355 | A1 | 7/2004 | Carey et al. | |

FOREIGN PATENT DOCUMENTS

| | | | |
|---|---|---|---|
| EP | 1640442 | A1 | 3/2006 |
| JP | 07054627 | | 2/1995 |
| JP | 11294133 | | 10/1999 |
| WO | 9964543 | A1 | 12/1999 |
| WO | 2006014866 | A1 | 2/2006 |
| WO | 2006032271 | A1 | 3/2006 |
| WO | 2007/047446 | | 4/2007 |

OTHER PUBLICATIONS

Patent Abstracts of Japan, JP Publication No. 11294133, "Cylinder Lubricator of Internal Combustion Engine", Oct. 26, 1999, Mitsubishi Heavy Ind Ltd.

Corresponding International Publication No. WO 2007/044909 A1 & Search Report published Apr. 19, 2007.

Written Opinion from corresponding international application No. PCT/US2006/040115 mailed Feb. 14, 2007.

* cited by examiner

*Primary Examiner* — Walter D Griffin
*Assistant Examiner* — Frank C Campanell
(74) *Attorney, Agent, or Firm* — David M. Shold; Christopher D. Hilker

(57) ABSTRACT

A method of lubricating a marine diesel 2-stroke engine comprising: (1) monitoring performance characteristics of said engine; (2) selecting a lubricating composition to modify the performance characteristics of the engine, wherein the lubricating composition is prepared by in-situ controlled blending of at least two different fluids, said fluids comprising: (i) a first fluid comprising an additive package with one or more overbased detergents, and optionally other performance additives; (ii) a second fluid comprising an additive package with one or more neutral detergents or overbased detergents, and optionally other performance additives, with the proviso that the first fluid has a ratio of Σ(wt % of overbased detergents)/Σ(wt % of all additives in the fluid) greater than the second fluid; and (iii) a third fluid comprising an oil of lubricating viscosity; and (3) supplying the lubricating composition of step (2) to the engine, with the proviso that the lubricating composition comprises at least one of the first fluid or the second fluid.

8 Claims, No Drawings

LUBRICATING COMPOSITIONS

FIELD OF INVENTION

The present invention relates to a method of lubricating an internal combustion engine by monitoring engine performance and adding an additive package accordingly. The invention further relates to a composition suitable for the method, prepared from at least three fluids.

BACKGROUND OF THE INVENTION

It is known to provide a 2-stroke marine diesel internal combustion engine marine diesel cylinder with 40 TBN or 70 TBN lubricants containing various additives to reduce wear and improve cleanliness, especially to cylinder liners and piston rings. Often engine operating temperatures and pressures are sufficient to break down the film of the oil of lubricating viscosity on the internal walls of the cylinder, and increased wear and decreased engine cleanliness due to deposits occurs.

Further, typical marine diesel cylinder lubricants are treated at approximately 1.2 to 1.3 g/kW hr. However, marine diesel cylinder lubricants treated at the typical feed rates and higher sulphur fuels often produce higher emissions of $SO_x$ (sulphur oxides), $NO_x$ (nitrogen oxides) and particulate matter such as soot and oxides of sulphur. With lower sulphur fuels, marine diesel engines may be able to operate with a reduced lubricant feed rate, and reduced emissions of $SO_x$ and $NO_x$.

However, due to variations in sulphur content of fuel, the amount of TBN required varies as the amount of base required to neutralise sulphuric acid produced during combustion changes. The presence of excessive amounts of unreacted compounds in an additive package providing TBN, e.g., detergents, can contribute to the formation of deposits. To overcome differences in the sulphur content of fuel, two or more lubricating compositions are independently available for use with differing TBN. One lubricating composition has TBN of 40 to 50 suitable for low sulphur containing fuel, whereas the second lubricating composition has a TBN of 70 or more and is used for higher sulphur containing fuel.

Therefore it would be desirable to have a method of controlling the soot and deposit formation and the amount of TBN required to optimize neutralization of sulphur acids, whilst allowing for variable metering rates of lubricating compositions. The present invention provides such a method.

US Patent Application 2003/0196632 A1 discloses a method to employ instrumentation to effectuate variation in lubricant flow rate in response to actual engine conditions. The method regularly monitors one or more engine parameters with instruments such as XRF or IR for base number measurement. The measured engine parameters are used to calculate the feed rate of lubricant to the engine.

US Patent Application 2003/0159672 A1 discloses a method of regularly monitoring one or more engine parameters of an all-loss lubricating system and calculating from the engine parameters an amount of a secondary fluid that is required to be added to base fluid to create a modified base lubricant that is applied to the engine during operations.

US Patent Application 2003/0183188 A1 discloses a device and a process for real time optimizing engine lubricating oil properties in response to actual operating conditions. The process includes on-line modification of lubricant properties by repeatedly measuring a system that recirculates a base lubricant and one or more system condition parameters at a location of interest. The process then calculates an amount of secondary fluid to add to the lubricant followed by mixing the base fluid with the secondary fluid creating a modified base lubricant and applying to a location of interest.

International Application WO 99/64543 A1 discloses diesel cylinder oil having a viscosity of 15 to 27 $mm^2/s$ (or cSt), a viscosity index of at least 95 and a TBN of at least 40 mg KOH/g. The oil is a neutral base stock of no more than 725 SUS viscosity at 100° C. and 2 to 15 wt % of the oil a liquid polyisobutylene with a viscosity of 1500 to 8000 $mm^2/s$ (cSt) at 100° C.

SUMMARY OF THE INVENTION

In one embodiment the present invention provides a method of lubricating a marine diesel 2-stroke engine comprising:

(1) monitoring performance characteristics of said engine;

(2) selecting a lubricating composition to modify the performance characteristics of the engine, wherein the lubricating composition is prepared by in-situ controlled blending of at least two different fluids selected from the group consisting of:

(i) a first fluid comprising an additive package with one or more overbased detergents, and optionally other performance additives;

(ii) a second fluid comprising an additive package with one or more neutral detergents or overbased detergents, and optionally other performance additives, with the proviso that the first fluid has a ratio of Σ(wt % of overbased detergents)/Σ(wt % of all additives in the fluid) greater than the second fluid; and (iii) a third fluid comprising an oil of lubricating viscosity; and (3) supplying the lubricating composition of step (2) to the engine, with the proviso that the lubricating composition comprises at least one of the first fluid or the second fluid.

In one embodiment the present invention provides a method of lubricating a marine diesel 2-stroke engine comprising:

(1) monitoring performance characteristics of said engine;

(2) selecting a lubricating composition to modify the performance characteristics of the engine, wherein the lubricating composition is prepared by in-situ controlled blending of at least three different fluids, said fluids comprising:

(i) a first fluid comprising an additive package with one or more overbased detergents, and optionally other performance additives;

(ii) a second fluid comprising an additive package with one or more neutral detergents or overbased detergents, and optionally other performance additives, with the proviso that the first fluid has a ratio of Σ(wt % of overbased detergents)/Σ(wt % of all additives in the fluid) greater than the second fluid; and (iii) a third fluid comprising an oil of lubricating viscosity; and (3) supplying the lubricating composition of step (2) to the engine.

DETAILED DESCRIPTION OF THE INVENTION

The present invention provides a method for lubricating an internal combustion engine as described above.

In several embodiments the method requires the lubricating composition prepared by blending at least two and/or three different fluids to have a TBN (mg/KOH) ranging from 20 to 100, or 30 to 80. Typically the lubricating composition has a TBN of 40 or 70.

Monitoring Performance Characteristics

The performance characteristics of an engine which may be monitored include wear, engine load, variation in TBN, deposits, or corrosion, and these may be monitored directly or indirectly. Wear may be measured by a number of techniques including determining the metal or metal oxide particles present in scrape down lubricant from a cylinder liner. Other examples of monitoring engine performance include measuring the sulphur content of the fuel, the load of an engine and TBN of the lubricant. A more detailed description of possible techniques for monitoring performance characteristics of an engine is disclosed in US Patent Application 2003/0159672.

In one embodiment the TBN of the lubricant may be determined by a method of determining the total base number of a used lubricant from an open, all-loss, lubricating system comprising: (a) applying an AC voltage signal between electrodes immersed in the used lubricant, (b) measuring the used lubricant dependent response to the applied signal, and (c) determining the used lubricant base number from the measured response. A more detailed description of the method of determining TBN of the lubricant is disclosed in co-pending U.S. application Ser. No. 11/250,274 (by inventors Boyle, Kampe and Lvovich).

In one embodiment the performance characteristics of the engine monitored comprise the sulphur content of the fuel and/or the TBN of the lubricant.

In several embodiments the engine may be operated at different lubricant feed rates. Examples of suitable lubricant feed rates range from 0.65 to 1.3 g/kW hr (that is g/hr per kW of engine power), 0.65 to 1.2 g/kW hr or 0.7 to 1.1 g/kW hr.

Lubricating Composition

The method requires selecting a lubricating composition to modify the performance characteristics of the engine. The lubricating composition is prepared by in-situ controlled blending of, in one embodiment, at least three different fluids, or, alternatively, at least two different fluids.

Controlled blending may be carried out by any known blending process known in the art, provided the amounts of additive are metered to provide the lubricating composition required to modify the characteristics of the engine.

In some embodiments the number of fluids required ranges from 2 or 3 to 8, or 3 to 6, or 3 to 4. In one embodiment the number of fluids is 3.

In the ratio Σ(wt % of overbased detergents)/Σ(wt % of all additives in the fluid), the wt % of all additives in the fluid includes the wt % of overbased detergent and the wt % of other performance additives.

In one embodiment the ratio of Σ(wt % of overbased detergents)/Σ(wt % of all additives in the fluid) for both the first and second fluids are non-zero.

The overbased detergent in the first and/or second fluid comprises salicylates, salixarates, sulphonates, phenates or a mixed substrate detergents.

The neutral detergent in the first and/or second fluid comprises salicylates, salixarates, sulphonates, phenates or a mixed substrate detergents.

The overbased detergent typically has a TBN of at least 200 or at least 230 or at least 300. Upper values of TBN include 600, 550 or 500. Suitable ranges of TBN include 200 to 600 or 230 to 550.

Neutral detergents typically have a TBN of less than 200 or less than 175. Examples of ranges of TBN for neutral detergents include 1 to 200 or 20 to 175.

In one embodiment the mixed substrate detergent (often referred to as complex/hybrid detergent) is prepared as in WO97/46643, WO97/46644, WO97/46645, WO97/46646 and WO97/46647. The mixed substrate is also defined in paragraphs 21 to 26 of US Patent Application 2005/0153847. Typically the mixed substrate detergent comprises a complex/hybrid of a sulphonate and a phenate, optionally in the presence of a salicylate.

Typically fluid 1 comprises a higher ratio of overbased detergent to all additives, compared to the second fluid.

In one embodiment the first fluid comprises an overbased detergent wt % greater than the wt % of overbased detergent in the second fluid.

Typically the first fluid comprises a wt % of an overbased detergent present at greater than 50 wt % to 100 wt % or 55 wt % to 90 wt % relative to the total amount of detergent present.

Typically the second fluid comprises an overbased detergent present from 0 wt % to less than 50 wt % or 5 wt % to 45 wt % relative to the total amount of detergent present.

In one embodiment the first fluid comprises an overbased sulphonate detergent with a TBN of at least 300; and the second fluid comprises a phenate detergent with a TBN of less 200.

Third Fluid

The third fluid comprises an oil of lubricating viscosity. Typically the oil of lubricating viscosity has a viscosity ranging from 2 $mm^2/s$ to 40 $mm^2/s$ or to 50 $mm^2/s$. Examples of a suitable oil of lubricating viscosity comprise new (i.e. fresh or unused) and/or used system oil (may also be referred to as light neutral base oil), heavy neutral base oil, bright stock or a polymeric thickener, or mixtures thereof.

Such oils include natural and synthetic oils, oil derived from hydrocracking, hydrogenation, and hydrofinishing, unrefined, refined and re-refined oils and mixtures thereof. Hydrotreated naphthenic oils are also known and can be used, as well as oils prepared by a Fischer-Tropsch gas-to-liquid synthetic procedure as well as other gas-to-liquid oils. In one embodiment the dispersant mixture of the present invention is useful when employed in a gas-to-liquid oil.

The source of the third fluid in one embodiment is a new or used crankcase system oil from a 2-stroke engine or fresh from a system oil tank without further processing. In one embodiment the used system oil is additised with an additive package to make it useful as a cylinder lubricant.

In one embodiment the lubricating composition is an SAE 50 grade lubricant.

The polymeric thickener includes styrene-butadiene rubbers, ethylene-propylene copolymers, hydrogenated styrene-isoprene polymers, hydrogenated radical isoprene polymers, poly(meth)acrylate acid esters, polyalkyl styrenes, polyolefins (such as polyisobutylene), polyalkylmethacrylates and esters of maleic anhydride-styrene copolymers. In one embodiment the polymeric thickener is free of polyisobutylene; and in another embodiment the polymeric thickener is a polyisobutylene. In one embodiment the polymeric thickener is poly(meth)acrylate.

The polymeric thickener in several embodiments has a weight average molecular weight (Mw) of more than 8000, or 8400 or more, at least 10,000, or at least 15,000, or at least 25,000 or at least 35,000. The polymeric thickener generally has no upper limit on Mw, however in one embodiment the Mw is less than 2,000,000 in another embodiment less than 500,000 and in another embodiment less than 150,000. Examples of suitable ranges of Mw include in one embodiment 12,000 to 1,000,000, in another embodiment 20,000 to 300,000 and in another embodiment 30,000 to 75,000.

Performance Additives in First and Second Fluids

The invention further typically provides other performance additives which may be present in at least one of the first and/or second fluid. Optionally the lubricating composition includes at least one performance additive selected from the group consisting of metal deactivators, dispersants, antioxidants, antiwear agents, corrosion inhibitors, antiscuffing agents, extreme pressure agents, foam inhibitors, demulsifiers, friction modifiers, pour point depressants and mixtures thereof. Typically, fully-formulated lubricating oil will contain one or more of these performance additives.

The total combined amount of the optional performance additives present in one embodiment from 0 or 0.01 to 25, in another embodiment 0 or 0.01 to 20, in another embodiment 0 or 0.01 to 15 and in another embodiment 0.05 or 0.1 or 0.5 to 10 weight percent of the lubricating composition.

Antiwear Agent

In one embodiment of the invention the lubricating composition further comprises an antiwear agent such as a metal hydrocarbyl dithiophosphate. Examples of a metal hydrocarbyl dithiophosphate include zinc dihydrocarbyl dithiophosphates (often referred to as ZDDP, ZDP or ZDTP). Examples of suitable zinc hydrocarbyl dithiophosphates compounds include the reaction product(s) of butyl/pentyl, heptyl, octyl, nonyl dithiophosphoric acids zinc salts or mixtures thereof.

In an alternative embodiment the antiwear agent is ashless, i.e., the antiwear agent is metal-free. In one embodiment the metal-free antiwear agent is an amine salt. The ashless antiwear agent often contains an atom including sulphur, phosphorus, boron or mixtures thereof.

Dispersant

The invention optionally further includes a dispersant. The dispersant is known and includes an ash-containing dispersant or an ashless-type dispersant, "ashless" dispersant being so named because, prior to mixing with other components of the lubricant, they do not contain metals which form sulfated ash. After admixture, of course, they may acquire metal ions from other components; but they are still commonly referred to as "ashless dispersants." The dispersant may be used alone or in combination with other dispersants. In one embodiment the ashless dispersant does not contain ash-forming metals. Ashless type dispersants are characterised by a polar group attached to a relatively high molecular weight hydrocarbon chain. Typical ashless dispersants include a N-substituted long chain hydrocarbon succinimide such as alkenyl succinimide. Examples of N-substituted long chain alkenyl succinimides include polyisobutylene succinimide with number average molecular weight of the polyisobutylene substituent in one embodiment from 350 to 5000, and in another embodiment 500 to 3000. Succinimide dispersants and their preparation are disclosed, for instance in U.S. Pat. No. 4,234,435. Succinimide dispersants are typically the imide formed from a polyamine, typically a poly(ethyleneamine).

In one embodiment the invention the dispersant is derived from polyisobutylene, an amine and zinc oxide to form a polyisobutylene succinimide complex with zinc.

In one embodiment the dispersant is derived from half ester, ester or salts of a long chain hydrocarbon acylating agent such as long chain alkenyl succinic acid/anhydride.

Another class of ashless dispersant is Mannich bases. Mannich dispersants are the reaction products of alkyl phenols with aldehydes (especially formaldehyde) and amines (especially polyalkylene polyamines). The alkyl group typically contains at least 30 carbon atoms.

The dispersant may also be post-treated by conventional methods by a reaction with any of a variety of agents. Among these are urea, thiourea, dimercaptothiadiazole or derivatives thereof, carbon disulphide, aldehydes, ketones, carboxylic acids, hydrocarbon-substituted succinic anhydrides, maleic anhydride, acrylonitrile, epoxides, boron compounds, and phosphorus compounds.

In one embodiment of the invention the dispersant is borated using a variety of agents selected from the group consisting of the various forms of boric acid (including metaboric acid, $HBO_2$, orthoboric acid, $H_3BO_3$, and tetraboric acid, $H_2B_4O_7$), boric oxide, boron trioxide, and alkyl borates.

The borated dispersant may be prepared by blending the boron compound and the N-substituted long chain alkenyl succinimides and heating them at a suitable temperature in one embodiment from 80° C. to 250° C., in another embodiment 90° C. to 230° C. and in another embodiment 100° C. to 210° C., until the desired reaction has occurred. The molar ratio of the boron compounds to the N-substituted long chain alkenyl succinimides is typically 10:1 to 1:4, in another embodiment 4:1 to 1:3, and in another embodiment about 1:2. An inert liquid may be used in performing the reaction. The liquid may include toluene, xylene, chlorobenzene, dimethylformamide and mixtures thereof.

Other performance additives may be used, such as an antioxidant including a diphenylamine, a hindered phenol, a molybdenum dithiocarbamate, a sulphurised olefin and mixtures thereof (in one embodiment the lubricating composition is free of an antioxidant); corrosion inhibitors including octylamine octanoate; condensation products of dodecenyl succinic acid or anhydride and a fatty acid such as oleic acid with a polyamine; metal deactivators including derivatives of benzotriazoles, 1,2,4-triazoles, benzimidazoles, 2-alkyldithiobenzimidazoles or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides; and friction modifiers including fatty acid derivatives such as amines, esters, epoxides, fatty imidazolines, condensation products of carboxylic acids and polyalkylene-polyamines and amine salts of alkylphosphoric acids.

The in-situ blending conditions include a temperature in one embodiment from 15° C. to 130° C., in another embodiment 20° C. to 120° C. and in another embodiment 25° C. to 110° C.; and for a period of time in one embodiment from 30 seconds to 48 hours, in another embodiment 2 minutes to 24 hours, and in other embodiments 5 minutes to 16 hours or 20 minutes to 4 hours; and at pressures in one embodiment from 86 kPa to 270 kPa (650 mm Hg to 2000 mm Hg), in another embodiment 92 kPa to 200 kPa (690 mm Hg to 1500 mm Hg), and in another embodiment 95 kPa to 130 kPa (715 mm Hg to 1000 mm Hg).

Industrial Application

The method of the present invention is useful for a 2-stroke marine diesel internal combustion engine.

In one embodiment of the invention provides a method for lubricating a 2-stroke marine diesel internal combustion engine, comprising supplying thereto a lubricant comprising the composition as described herein. The use of the composition may impart one or more of TBN control, cleanliness properties, antiwear performance and deposit control.

The following examples provide an illustration of the invention. These examples are non exhaustive and are not intended to limit the scope of the invention.

EXAMPLES

Preparative Examples 1-3

Preparative Examples 1-3 are Fluid 1, Fluid 2 and Fluid 3 respectively.

Fluid 1 comprises base oil, 30.8 wt % of a 400 TBN sulphonate, 11.2 wt % of 150 TBN phenate. Fluid 1 has a TBN of 140.

Fluid 2 comprises base oil, 15.8 wt % of 400 TBN sulphonate, 11.2 wt % of 150 TBN phenate. Fluid 2 has a TBN of 80.

Fluid 3 comprises marine diesel system oil.

Examples 1-14

Examples 1-14 are marine diesel cylinder lubricants prepared by blending Fluids 1-3. The lubricants provide effective sufficient detergency and antiwear performance suitable for allowing a 2-stroke marine diesel engine to reduce lubricant feed rate and/or to vary fuel sulphur content. The lubricants prepared are shown in Tables 1-3.

TABLE 1

Variable TBN Lubricants to Neutralise Acid Generated Fuel Sulphur

| | Wt % of fluids 1-3 in Marine Diesel Lubricant | | | |
|---|---|---|---|---|
| Fluid | Ex1 | Ex2 | Ex3 | Ex4 |
| 1 | 50 | 33.3 | 16.7 | 0 |
| 2 | 0 | 16.7 | 33.3 | 50 |
| 3 | 50 | 50 | 50 | 50 |
| Phenate Detergent (%) | 3.6 | 3.6 | 3.6 | 3.6 |
| Antiwear (wt %) | 1.25 | 1.25 | 1.25 | 1.25 |

TABLE 2

70 TBN Lubricants Suitable for Reduced Lubricant Feed Rates

| | Wt % of fluids 1-3 in Marine Diesel Lubricant | | | | |
|---|---|---|---|---|---|
| Fluid | Ex5 | Ex6 | Ex7 | Ex8 | Ex9 |
| 1 | 50 | 59.1 | 65 | 72.2 | 81.3 |
| 2 | 0 | 0 | 0 | 0 | 0 |
| 3 | 50 | 40.9 | 35 | 27.8 | 18.7 |
| Phenate substrate (%) | 3.6 | 3.6 | 3.6 | 3.6 | 3.6 |
| MDCL Feed Rate (g/kW hr) | 1.3 | 1.1 | 1.0 | 0.9 | 0.8 |

MDCL—marine diesel cylinder lubricant.

TABLE 3

40 TBN Lubricants Suitable for Reduced Lubricant Feed Rates

| | Wt % of fluids 1-3 in Marine Diesel Lubricant | | | | |
|---|---|---|---|---|---|
| Fluid | Ex10 | Ex11 | Ex12 | Ex13 | Ex14 |
| 1 | 0 | 0 | 0 | 0 | 0 |
| 2 | 50 | 59.1 | 65 | 72.2 | 81.3 |
| 3 | 50 | 40.9 | 35 | 27.8 | 18.7 |
| Phenate Detergent (%) | 3.6 | 3.6 | 3.6 | 3.6 | 3.6 |
| MDCL Feed Rate (g/kW hr) | 1.3 | 1.1 | 1.0 | 0.9 | 0.8 |

While the invention has been explained, it is to be understood that various modifications thereof will become apparent to those skilled in the art upon reading the specification. Therefore, it is to be understood that the invention disclosed herein is intended to cover such modifications as fall within the scope of the appended claims.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, diluents oils (which may be taken to be 35 to 55%, or about 45%, for commercial detergents) and other such materials which are normally understood to be present in the commercial grade. It is to be understood that the upper and lower amount, range, and ratio limits set forth herein may be independently combined. Similarly, the ranges and amounts for each element of the invention may be used together with ranges or amounts for any of the other elements. As used herein any member of a genus (or list) may be excluded from the claims.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

(iii) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, or no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

What is claimed is:

1. A method of lubricating a cylinder liner of a marine diesel 2-stroke engine comprising:

(1) monitoring performance characteristics of said engine;

(2) selecting a lubricating composition to modify the performance characteristics of the engine, wherein the lubricating composition is prepared by in-situ controlled blending of at least three different fluids, said fluids comprising:

(i) a first fluid comprising an additive package with one or more over-based detergents, and optionally other performance additives;

(ii) a second fluid comprising an additive package with one or more neutral detergents or overbased detergents, and optionally other performance additives, with the proviso that the first fluid has a ratio of Σ(wt % of overbased detergents)/Σ(wt % of all additives in the fluid) greater than the second fluid; and (iii) a third fluid comprising an oil of lubricating viscosity, wherein the oil of lubricating viscosity is new system oil, used system oil, or mixtures thereof; and (3) supplying the lubricating composition of step (2) to the engine.

2. The method of claim 1, wherein the lubricating composition has a TBN ranging from 20 to 100.

3. The method of claim 1, wherein the performance characteristics comprise the sulphur content of the fuel or the TBN of the lubricant.

4. The method of claim 1, wherein the marine diesel 2-stroke engine has a lubricant feed rate ranging from 0.65 to 1.3 g/kW hr.

5. The method of claim 1, wherein the overbased detergent of fluid (i) has a TBN of at least 200.

6. The method of claim 1, wherein the neutral detergents or overbased detergents comprise salicylates, salixarates, sulphonates, phenates or mixed substrate detergents.

7. The method of claim 1, wherein the first fluid comprises an overbased sulphonate detergent with a TBN of at least 300; and the second fluid comprises a phenate detergent with a TBN of less 200.

8. The method of claim 1, wherein the ratio of Σ(wt % of overbased detergents)/Σ(wt % of all additives in the fluid) for both the first and second fluids are non-zero.

* * * * *